US011311151B2

(12) United States Patent
Nowotarski

(10) Patent No.: US 11,311,151 B2
(45) Date of Patent: Apr. 26, 2022

(54) SOAP DISPENSING SHOWER ASSEMBLY

(71) Applicant: Daniel Nowotarski, Grayslake, IL (US)

(72) Inventor: Daniel Nowotarski, Grayslake, IL (US)

( * ) Notice: Subject to any disclaimer, the term of this patent is extended or adjusted under 35 U.S.C. 154(b) by 79 days.

(21) Appl. No.: 16/986,685

(22) Filed: Aug. 6, 2020

(65) Prior Publication Data

US 2022/0039610 A1 Feb. 10, 2022

(51) Int. Cl.

| | |
|---|---|
| ***A47K 5/12*** | (2006.01) |
| ***B05B 1/18*** | (2006.01) |
| ***B05B 7/32*** | (2006.01) |

(52) U.S. Cl.

CPC ..... *A47K 5/1211* (2013.01); *B05B 1/18* (2013.01); *B05B 7/32* (2013.01); *A47K 2201/02* (2013.01)

(58) Field of Classification Search

CPC .... A47K 5/1211; A47K 2201/02; A47K 5/12; A47K 5/1217; B05B 1/18; B05B 7/32; B65D 23/003; B65D 7/38

USPC ..... 222/181.3, 63, 74, 191, 372; 401/42; 239/302, 310, 314, 315

See application file for complete search history.

(56) References Cited

U.S. PATENT DOCUMENTS

| | | | | |
|---|---|---|---|---|
| 4,998,836 | A | 3/1991 | Scripnick | |
| 5,517,705 | A | 5/1996 | Jackson | |
| 6,983,866 | B2 | 1/2006 | Smart | |
| 7,040,830 | B2 | 5/2006 | Kliegman | |
| 8,141,565 | B2 | 3/2012 | Slavin | |
| 9,084,514 | B1 | 7/2015 | Elswick | |
| 9,359,748 | B1 * | 6/2016 | Lamy | B05B 7/1254 |
| 2010/0213279 | A1 * | 8/2010 | Frederick | B05B 1/18 239/310 |
| 2014/0196227 | A1 | 7/2014 | Cooper | |
| 2019/0060926 | A1 * | 2/2019 | Benitez | B05B 7/2443 |

* cited by examiner

*Primary Examiner* — Vishal Pancholi
*Assistant Examiner* — Robert K Nichols, II

(57) ABSTRACT

A soap dispensing shower assembly for a shower enclosure to free a hand of the user for enhanced stability includes a reservoir, a pump, and a tube. The reservoir is mountable to a wall proximate to a water inlet of a shower enclosure. A liquid soap solution is positionable in the reservoir. The pump is engaged to and positioned within the reservoir. The tube is engaged to the pump and extends from the reservoir. The tube extends along a hose extending between the water inlet and a spray head so that a terminus of the tube is positioned proximate to the spray head. The pump selectively dispenses the liquid soap solution through the tube onto a user.

16 Claims, 4 Drawing Sheets

SOAP DISPENSING SHOWER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to soap dispensing assemblies and more particularly pertains to a new soap dispensing assembly for use in a shower enclosure to free a hand of the user for enhanced stability.

(2) Description of Related Art Including Information Disclosed Under 37 CFR 1.97 and 1.98

The prior art relates to soap dispensing assemblies. Prior art shower assemblies with soap dispensing capability generally comprise a reservoir that is positioned in a handheld housing, a mounted reservoir with a venturi valve, or a manual pumping mechanism.

BRIEF SUMMARY OF THE INVENTION

An embodiment of the disclosure meets the needs presented above by generally comprising a reservoir, a pump, and a tube. The reservoir is configured to be mountable to a wall proximate to a water inlet of a shower enclosure and to have a liquid soap solution positioned therewithin. The pump is engaged to and positioned within the reservoir. The tube is engaged to the pump and extends from the reservoir. The tube is configured to engage a hose extending between the water inlet and a spray head so that a terminus of the tube is positioned proximate to the spray head. The pump is configured to selectively dispense the liquid soap solution through the tube onto a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
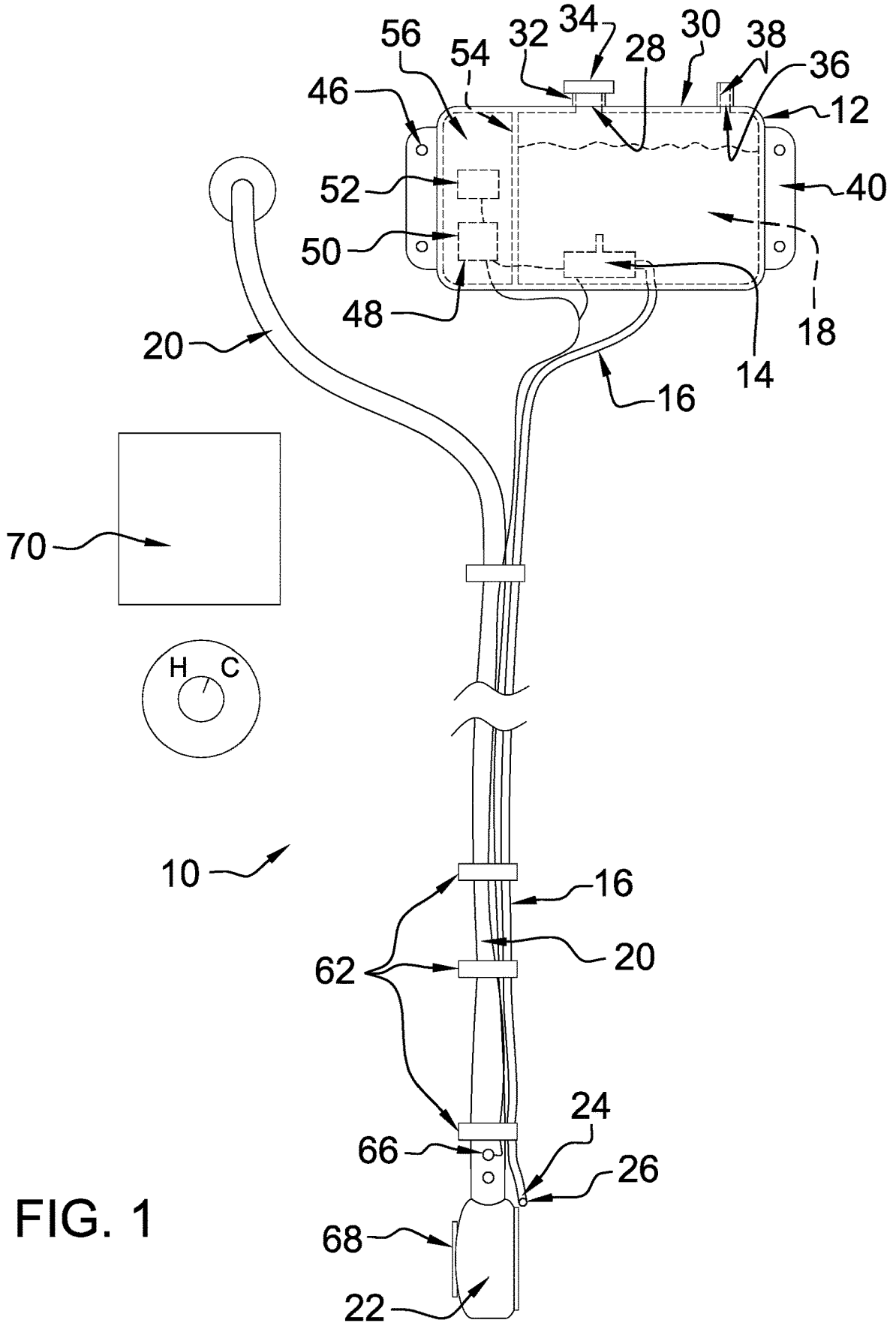
FIG. 1 is a front view of a soap dispensing shower assembly according to an embodiment of the disclosure.
Figure 2:
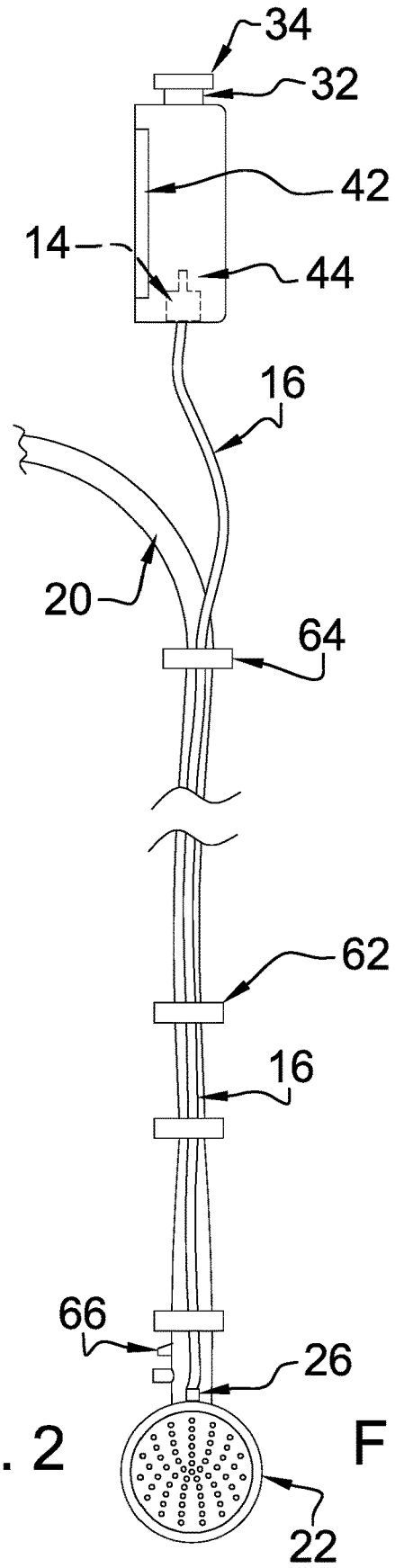
FIG. 2 is a side view of an embodiment of the disclosure.
Figure 3:
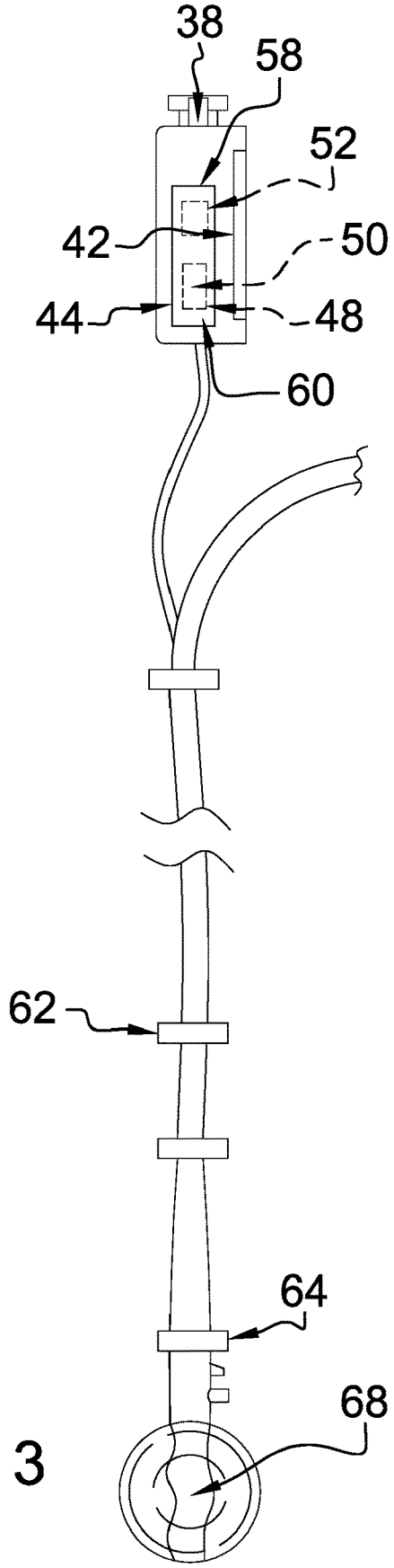
FIG. 3 is a side view of an embodiment of the disclosure.
Figure 4:
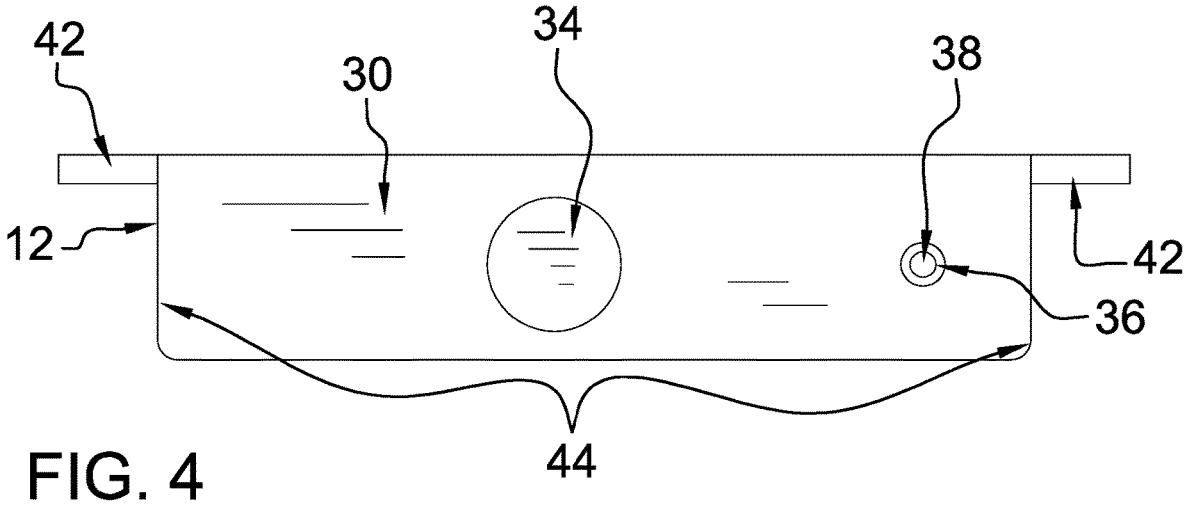
FIG. 4 is a top view of an embodiment of the disclosure.

With reference now to the drawings, and in particular to FIGS. 1 through 5 thereof, a new soap dispensing assembly embodying the principles and concepts of an embodiment of the disclosure and generally designated by the reference numeral 10 will be described.

As best illustrated in FIGS. 1 through 5, the soap dispensing shower assembly 10 generally comprises a reservoir 12, a pump 14, and a tube 16. The reservoir 12 is configured to be mountable to a wall proximate to a water inlet of a shower enclosure and to have a liquid soap solution 18 positioned therewithin. The pump 14 is engaged to and positioned within the reservoir 12. The tube 16 is engaged to the pump 14 and extends from the reservoir 12.

The tube 16 is configured to engage a hose 20 extending between the water inlet and a spray head 22 so that a terminus 24 of the tube 16 is positioned proximate to the spray head 22. The pump 14 is configured to selectively dispense the liquid soap solution 18 through the tube 16 onto a user. A nozzle 26 is engaged to the terminus 24 of the tube 16 and is configured to form a spray from the liquid soap solution 18 being dispensed through the tube 16.

The reservoir 12 has an orifice 28 positioned in a top 30 thereof. The orifice 28 is configured for addition of the liquid soap solution 18 into the reservoir 12. A lip 32 is coupled to the reservoir 12 and extends from the orifice 28. A cap 34 is selectively couplable to the lip 32 to close the orifice 28.

The reservoir 12 has an aperture 36 positioned in the top 30. A one-way valve 38 is engaged to the reservoir 12 and is positioned in the aperture 36. The one-way valve 38 is configured to allow entry of air into the reservoir 12.

A connector 40 is coupled to the reservoir 12 and is configured to engage the wall. The connector 40 thus is configured to mount the reservoir 12 to the wall. The connector 40 may comprise a pair of tabs 42. The tabs 42 are engaged to and extend singly from opposed sides 44 of the reservoir 12. Each tab 42 has a set of holes 46 positioned therethrough. Each hole 46 is configured for insertion of a respective article of mounting hardware (not shown) to engage the reservoir 12 to the wall. The present invention also anticipates the connector 40 comprising other connecting means, such as, but not limited to, suction cups, adhesives, and the like.

A battery 48 is operationally engaged to the pump 14 and is configured to selectively provide power thereto. The battery 48 may comprise a primary cell 50 and a backup cell 52, as shown in FIG. 1. A divider 54 is engaged to and positioned with the reservoir 12 to define a chamber 56. The battery 48 is positioned within the chamber 56.

A cutout 58 is positioned in the reservoir 12 and opens into the chamber 56. The cutout 58 is configured to allow access to the chamber 56 for servicing the battery 48. A panel 60 is selectively engageable to the reservoir 12 to close the cutout 58.

A plurality of fasteners 62 is engaged to the tube 16 and is configured to selectively engage the hose 20 extending between the water inlet and a spray head 22. The fasteners 62 thus are configured to engage the tube 16 to the hose 20. Each fastener 62 may comprise a hook and loop fastening strip 64, or other fastening means, such as, but not limited to, zip ties, pipe clamps, and the like.

A switch 66 is engaged to the tube 16 proximate to the terminus 24 and is operationally engaged to the battery 48 and the pump 14. The switch 66 is configured to be selectively switched to engage the battery 48 to the pump 14 to dispense the liquid soap solution 18 onto the user. The switch 66 also may be configured to be mountable to the spray head 22 proximate to an ON/OFF button thereof, as shown in FIG. 1.

Figure 5:
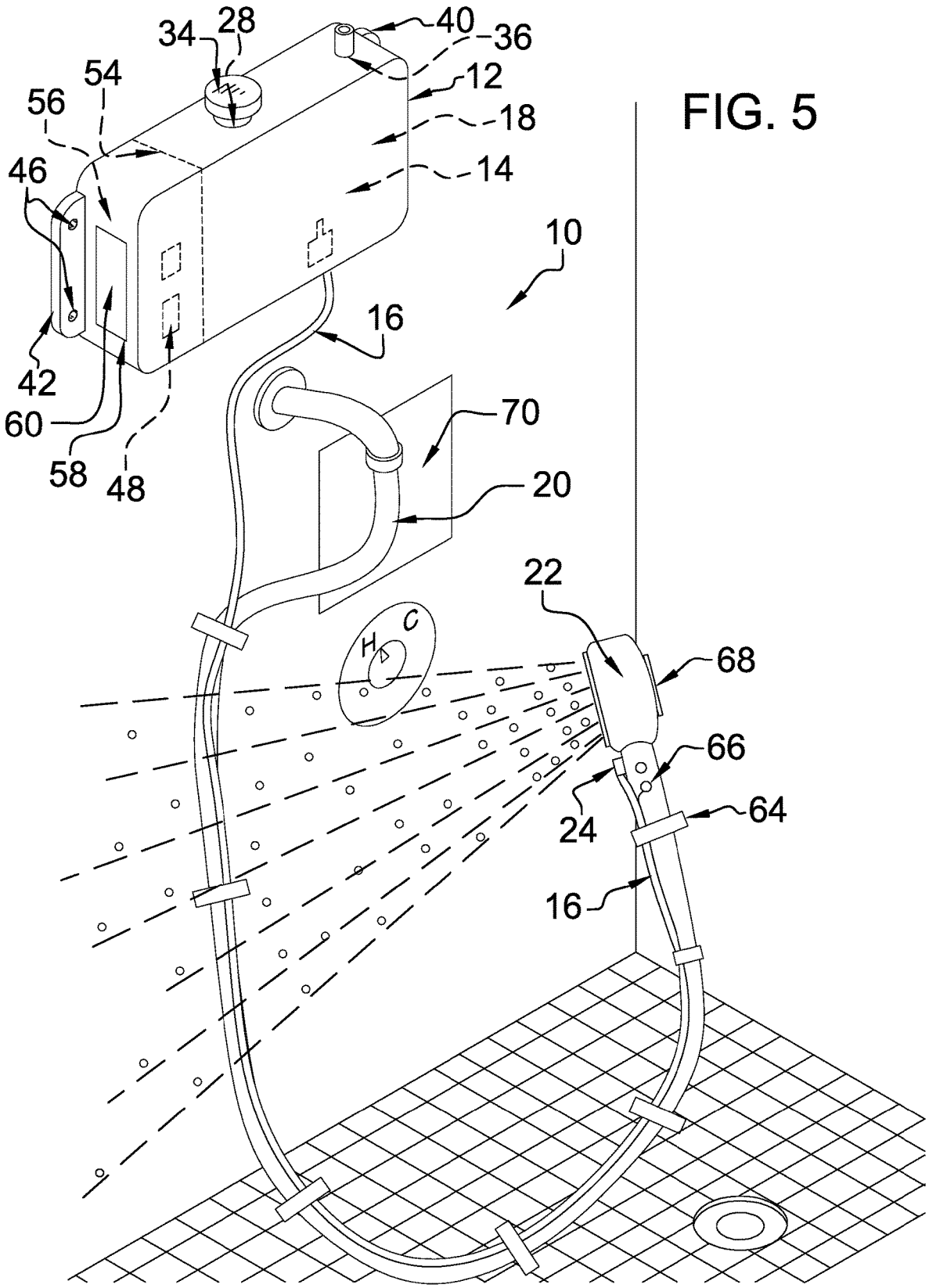
FIG. 5 is an in-use view of an embodiment of the disclosure.

The assembly 10 also comprises a magnet 68 and a plate 70, as shown in FIG. 5. The magnet 68 and the plate 70 are configured to be mountable to the spray head 22 and the wall, respectively. The plate 70 is ferromagnetic so that the magnet 68 is positioned to selectively and magnetically engage the plate 70 to engage the spray head 22 to the wall.

The present invention anticipates the tube 16 and the switch 66 being integral to the hose 20 and the spray head 22, respectively.

In use, the reservoir 12 is affixed to the wall and charged with the liquid soap solution 18. The tube 16 is extended along and affixed to the hose 20 using the fasteners 62 so that the nozzle 26 is positioned by the spray head 22. The user then can elect to have the liquid soap solution 18, the water, or a combination thereof, dispensed from the nozzle 26 and the spray head 22, respectively, by selectively actuating the switch 66 and the ON/OFF button.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A soap dispensing shower assembly comprising:

a reservoir configured to be mountable to a wall proximate to a water inlet of a shower enclosure and for positioning a liquid soap solution;

a pump engaged to and positioned within the reservoir, and a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user; and a connector coupled to the reservoir and being configured for engaging the wall, wherein the connector is configured for mounting the reservoir to the wall, the connector comprising a pair of tabs engaged to and extending singly from opposed sides of the reservoir, each tab having a set of holes positioned therethrough, wherein each hole is configured for insertion of a respective fastener for engaging the reservoir to the wall.

2. The soap dispensing shower assembly of claim 1, further including a nozzle engaged to the terminus of the tube and being configured for forming a spray from the liquid soap solution dispensed through the tube.

3. A soap dispensing shower assembly comprising:

a reservoir configured to be mountable to a wall proximate to a water inlet of a shower enclosure and for positioning a liquid soap solution;

a pump engaged to and positioned within the reservoir;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user;

the reservoir having an orifice positioned in a top thereof, wherein the orifice is configured for addition of the liquid soap solution into the reservoir;

a lip coupled to the reservoir and extending from the orifice; and a cap selectively couplable to the lip for closing the orifice.

4. A soap dispensing shower assembly comprising:

a reservoir configured to be mountable to a wall proximate to a water inlet of a shower enclosure and for positioning a liquid soap solution;

a pump engaged to and positioned within the reservoir;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user;

the reservoir having an aperture positioned in the top; and a one-way valve engaged to the reservoir and positioned in the aperture, wherein the one-way valve is configured for entry of air into the reservoir.

5. A soap dispensing shower assembly comprising:

a reservoir configured to be mountable to a wall proximate to a water inlet of a shower enclosure and for positioning a liquid soap solution;

a pump engaged to and positioned within the reservoir;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user;

a battery operationally engaged to the pump and being configured for selectively providing power thereto; and a switch engaged to the tube proximate to the terminus and being operationally engaged to the battery and the pump, wherein the switch is configured to be selectively switched to engage the battery to the pump for dispensing the liquid soap solution onto the user.

6. The soap dispensing shower assembly of claim 5, wherein the battery comprises a primary cell and a backup cell.

7. The soap dispensing shower assembly of claim 5, further including the switch being configured to be mountable to the spray head proximate to an ON/OFF button thereof.

8. The soap dispensing shower assembly of claim 5, further including:

a divider engaged to and positioned with the reservoir defining a chamber, the battery being positioned within the chamber;

a cutout positioned in the reservoir and opening into the chamber, wherein the cutout is configured for allowing access to the chamber for servicing the battery; and a panel selectively engageable to the reservoir for closing the cutout.

9. A soap dispensing shower assembly comprising:

a reservoir configured to be mountable to a wall proximate to a water inlet of a shower enclosure and for positioning a liquid soap solution;

a pump engaged to and positioned within the reservoir;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user; and a plurality of fasteners engaged to the tube and being configured for selectively engaging the hose extending between the water inlet and a spray head, wherein the fasteners are configured for engaging the tube to the hose.

10. The soap dispensing shower assembly of claim 9, wherein each fastener comprises a hook and loop fastening strip.

11. A soap dispensing shower assembly comprising:

a reservoir configured to be mountable to a wall proximate to a water inlet of a shower enclosure and for positioning a liquid soap solution;

a pump engaged to and positioned within the reservoir;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user;

a magnet configured to be mountable to the spray head; and a plate configured to be mountable to the wall, the plate being ferromagnetic such that the magnet is positioned for selectively magnetically engaging the plate for engaging the spray head to the wall.

12. A soap dispensing shower assembly comprising:

a hose configured to be operationally engaged to a water inlet of a shower enclosure;

a spray head engaged to the hose distal from the water inlet;

a reservoir configured to be mountable to a wall proximate to the water inlet and for positioning a liquid soap solution;

a pump engaged to and positioned within the reservoir;

a tube engaged to the pump and extending from the reservoir, the tube being engaged to and extending along the hose, such that a terminus of the tube is positioned proximate to the spray head, wherein the pump is configured to selectively dispense the liquid soap solution through the tube onto a user;

a nozzle engaged to the terminus of the tube and being configured for forming a spray from the liquid soap solution dispensed through the tube;

the reservoir having an orifice positioned in a top thereof, wherein the orifice is configured for addition of the liquid soap solution into the reservoir;

a lip coupled to the reservoir and extending from the orifice;

a cap selectively couplable to the lip for closing the orifice;

the reservoir having an aperture positioned in the top; and a one-way valve engaged to the reservoir and positioned in the aperture, wherein the one-way valve is configured for entry of air into the reservoir.

13. A soap dispensing shower assembly comprising:

a hose configured to be operationally engaged to a water inlet of a shower enclosure;

a spray head engaged to the hose distal from the water inlet;

a reservoir configured to be mountable to a wall proximate to the water inlet and for positioning a liquid soap solution;

a pump engaged to and positioned within the reservoir;

a tube engaged to the pump and extending from the reservoir, the tube being engaged to and extending along the hose, such that a terminus of the tube is positioned proximate to the spray head, wherein the pump is configured to selectively dispense the liquid soap solution through the tube onto a user;

a nozzle engaged to the terminus of the tube and being configured for forming a spray from the liquid soap solution dispensed through the tube; and a connector coupled to the reservoir and being configured for engaging the wall, wherein the connector is configured for mounting the reservoir to the wall, the connector comprising a pair of tabs engaged to and extending singly from opposed sides of the reservoir, each tab having a set of holes positioned therethrough, wherein each hole is configured for insertion of a respective fastener for engaging the reservoir to the wall.

14. A soap dispensing shower assembly comprising:

a hose configured to be operationally engaged to a water inlet of a shower enclosure;

a spray head engaged to the hose distal from the water inlet;

a reservoir configured to be mountable to a wall proximate to the water inlet and for positioning a liquid soap solution;

a pump engaged to and positioned within the reservoir;

a tube engaged to the pump and extending from the reservoir, the tube being engaged to and extending along the hose, such that a terminus of the tube is positioned proximate to the spray head, wherein the pump is configured to selectively dispense the liquid soap solution through the tube onto a user;

a nozzle engaged to the terminus of the tube and being configured for forming a spray from the liquid soap solution dispensed through the tube;

a battery operationally engaged to the pump and being configured for selectively providing power thereto;

a switch engaged to the tube the spray head being operationally engaged to the battery and the pump, wherein the switch is configured to be selectively switched to engage the battery to the pump for dispensing the liquid soap solution onto the user;

a divider engaged to and positioned with the reservoir defining a chamber, the battery being positioned within the chamber;

a cutout positioned in the reservoir and opening into the chamber, wherein the cutout is configured for allowing access to the chamber for servicing the battery; and a panel selectively engageable to the reservoir for closing the cutout.

15. A soap dispensing shower assembly comprising:

a hose configured to be operationally engaged to a water inlet of a shower enclosure;

a spray head engaged to the hose distal from the water inlet;

a reservoir configured to be mountable to a wall proximate to the water inlet and for positioning a liquid soap solution;

a pump engaged to and positioned within the reservoir;

a tube engaged to the pump and extending from the reservoir, the tube being engaged to and extending along the hose, such that a terminus of the tube is positioned proximate to the spray head, wherein the pump is configured to selectively dispense the liquid soap solution through the tube onto a user;

a nozzle engaged to the terminus of the tube and being configured for forming a spray from the liquid soap solution dispensed through the tube;

a magnet configured to be mountable to the spray head; and a plate configured to be mountable to the wall, the plate being ferromagnetic such that the magnet is positioned for selectively magnetically engaging the plate for engaging the spray head to the wall.

16. A soap dispensing shower assembly comprising:

a reservoir configured to be mountable to a wall proximate to a water inlet of a shower enclosure and for positioning a liquid soap solution, the reservoir having an orifice positioned in a top thereof, wherein the orifice is configured for addition of the liquid soap solution into the reservoir, the reservoir having an aperture positioned in the top;

a one-way valve engaged to the reservoir and positioned in the aperture, wherein the one-way valve is configured for entry of air into the reservoir;

a lip coupled to the reservoir and extending from the orifice;

a cap selectively couplable to the lip for closing the orifice;

a connector coupled to the reservoir and being configured for engaging the wall, wherein the connector is configured for mounting the reservoir to the wall, the connector comprising a pair of tabs engaged to and extending singly from opposed sides of the reservoir, each tab having a set of holes positioned therethrough, wherein each hole is configured for insertion of a respective fastener for engaging the reservoir to the wall;

a pump engaged to and positioned within the reservoir;

a battery operationally engaged to the pump and being configured for selectively providing power thereto, the battery comprising a primary cell and a backup cell;

a divider engaged to and positioned with the reservoir defining a chamber, the battery being positioned within the chamber;

a cutout positioned in the reservoir and opening into the chamber, wherein the cutout is configured for allowing access to the chamber for servicing the battery;

a panel selectively engageable to the reservoir for closing the cutout;

a tube engaged to the pump and extending from the reservoir, the tube being configured for engaging a hose extending between the water inlet and a spray head, such that a terminus of the tube is positioned proximate to the spray head, wherein the pump is configured to selectively dispense the liquid soap solution through the tube onto a user;

a nozzle engaged to the terminus of the tube and being configured for forming a spray from the liquid soap solution dispensed through the tube;

a plurality of fasteners engaged to the tube and being configured for selectively engaging the hose extending between the water inlet and a spray head, wherein the fasteners are configured for engaging the tube to the hose, each fastener comprising a hook and loop fastening strip;

a switch engaged to the tube proximate to the terminus and being operationally engaged to the battery and the pump, wherein the switch is configured to be selectively switched to engage the battery to the pump for dispensing the liquid soap solution onto the user, the switch being configured to be mountable to the spray head proximate to an ON/OFF button thereof;

a magnet configured to be mountable to the spray head; and a plate configured to be mountable to the wall, the plate being ferromagnetic such that the magnet is positioned for selectively magnetically engaging the plate for engaging the spray head to the wall.

* * * * *